US005365867A

United States Patent [19]

Hatch et al.

[11] Patent Number: 5,365,867

[45] Date of Patent: Nov. 22, 1994

[54] STYLE GROUP RECOGNITION SYSTEM FOR AUTOMATED SEWING PATTERNS

[75] Inventors: Nathaniel E. Hatch, Utica; Tadeusz Olewicz, Clinton; Ernst Schramayr, BarneVeld, all of N.Y.

[73] Assignee: Jet Sew Technologies, Inc., Bowling Green, Ky.

[21] Appl. No.: 113,429

[22] Filed: Aug. 27, 1993

[51] Int. Cl.[5] ..... D05B 21/00

[52] U.S. Cl. ..... 112/121.12; 112/104; 112/147; 112/262.3

[58] Field of Search ..... 112/121.12, 121.15, 112/104, 147, 265.1, 262.3, 266.1

[56] References Cited

U.S. PATENT DOCUMENTS 4,479,446 10/1984 Johnson et al. ..... 112/121.12
4,936,232 6/1990 Monma ..... 112/121.12 X
5,012,752 5/1991 Murata ..... 112/121.12
5,229,949 7/1993 Kondo et al. ..... 112/121.12 X

OTHER PUBLICATIONS

Dürkopp Adler AG, CNC 805 Article, 6 pages, *Computer Controlled Pocket Setting Unit.*

*Primary Examiner*—Peter Nerbun
*Attorney, Agent, or Firm*—Schweitzer Cornman & Gross

[57] ABSTRACT

There is disclosed a computerized control system for stitching apparel parts in various stitching patterns according to individual designs or styles. The control system prevents mismatching the hardware components used to hold the apparel parts during stitching thereof and a selected computerized program which controls an individual stitching pattern. A program may not be selected unless a code identifying such program is found to match the code which identifies the hardware used for a particular style or design.

6 Claims, 4 Drawing Sheets

STYLE GROUP RECOGNITION SYSTEM FOR AUTOMATED SEWING PATTERNS

BACKGROUND OF THE INVENTION

The present invention has application to industrial sewing equipment for automatically controlling sewing patterns and particularly to automatic pocket setters.

There are a number of automatic pocket setting machines currently used in the apparel industry. These machines are designed to handle nearly infinite numbers of patterns within certain limits, which are set by the size and design of the machine. Instead of being infinitely adjustable due to the economic and practical reasons, all automatic pocket setting machines are broken into two groups of components: 1. Changeable, 2. Permanent.

1. The "Changeable" group of components is designed for a unique pocket pattern/style and size. In general, every time a new pocket style, or size is to be processed on the pocket setting machine, a presently mounted group of these components is dismounted and a new group is mounted in its place. This group consists of the following components:

a) Pocket folding assembly, or better known as "Pocket Folding Group". It is a mechanical assembly designed to fold a pocket and set it on an apparel item (e.g. shirt front).

b) Pocket clamping and/or transferring assembly commonly known as "Stitching or Transfer Clamp". It is a mechanical assembly designed to clamp folded pocket on an apparel item and either transfer, and/or retain it during the sewing process.

The above assemblies are better known as the "Pocket Style Group".

a) CNC program, also referred to as "Pocket Part Program". This program is designed to control the motions of the components (motors, cylinders, cams, etc.) involved during the sewing process. This program usually resides in the machine's programmable controller in an Erasable Programmable Read Only Memory (EPROM), or in the memory of the controller itself. The machine operator, during a Style Group change, must either select a new program from the controller's memory, or physically change the EPROM. The combination of the Style Group and the Part Program is designed and developed as a set, per customer's specifications.

2. The "Permanent" group of components (not changeable) is designed to provide a support frame with work surfaces, operator controls and assisting fixtures, as well as motor drives, machine's main controller and sewing head.

Although the above described arrangement of Permanent and Changeable components has been found to be the only economical and a practical design solution to the automatic pocket setting, it has a serious inherent problem. If during the style change, the operator selects or plugs a CNC Part Program that does not match the newly installed Style Group, than a mismatch between the Stitching Clamp (which has a fixed machined path) and the CNC program (which controls the motion and the path of all axis during sewing) will result in potentially serious damage to the equipment, as well as costly machine down time. The present invention provides an economical solution to this problem.

SUMMARY OF THE INVENTION

The main purpose of the present invention is to improve the design of pocket setter machines, by eliminating the possibility for a potentially costly machine crash and down time, that could be caused by a mismatch between the Style Group and the CNC Pocket Program.

This invention is a unique system which activates a CNC Pocket Program, based on detected code from the Style Group currently mounted on the machine. The key element of this invention is an electronic decoder board equipped with special circuitry, which during every Style Group change procedure, or on a power up of the machine, reads a code from an electronically readable coded connector mounted on the Style Group. After reading the code, it activates the matching CNC program from its memory bank capable of storing any practical number of CNC Pocket Programs. This activated CNC program is than automatically transferred via a communication link to the machine's main controller; and the machine is ready for its normal operation. The second element of this system is a display unit designed to visually show and inform the operator which CNC Pocket Program was detected and activated by the board. Also, in case of an error, this display is designed to help the operator in the troubleshooting process. For example, if the board detects a Style Group code that cannot be matched with any CNC Pocket Program in its memory bank, the display will show an error message with possible causes and solutions to such error. The third and last element of this system is the above mentioned electronically readable coded connector, which contains a code that identifies the group. It is permanently attached to the Style Group assembly and it must be plugged into the machine during the Style Group change. The above described system ensures that the activated CNC Pocket Program will always match the Style Group, thus avoiding any possibility of crash between the Style Group and the Sewing Head.

DESCRIPTION OF A PARTICULAR EMBODIMENT

Figure 1:
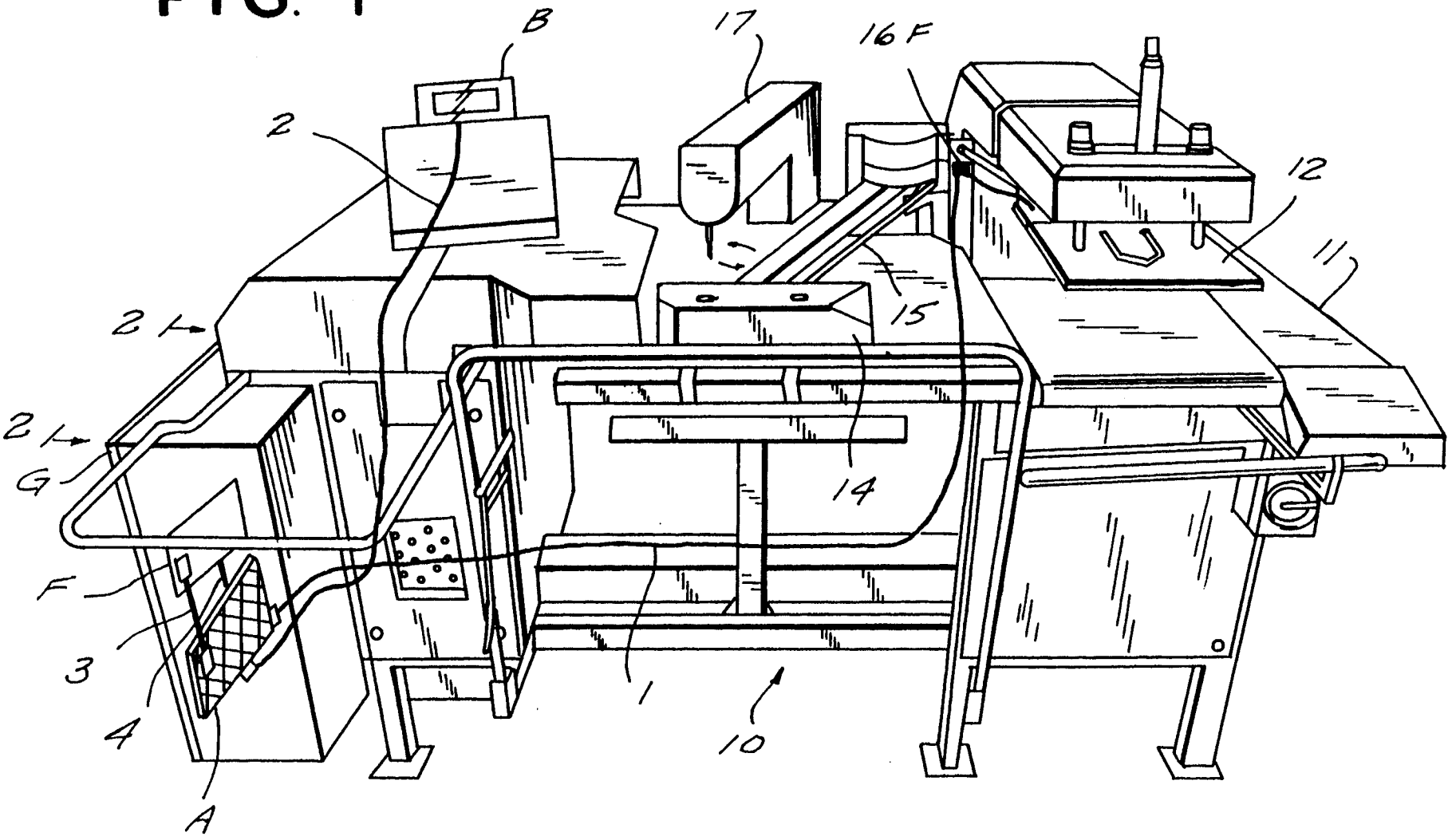
FIG. 1 illustrates the overall physical layout of a pocket-setting machine showing elements of the invention nested within it.
Figure 2:
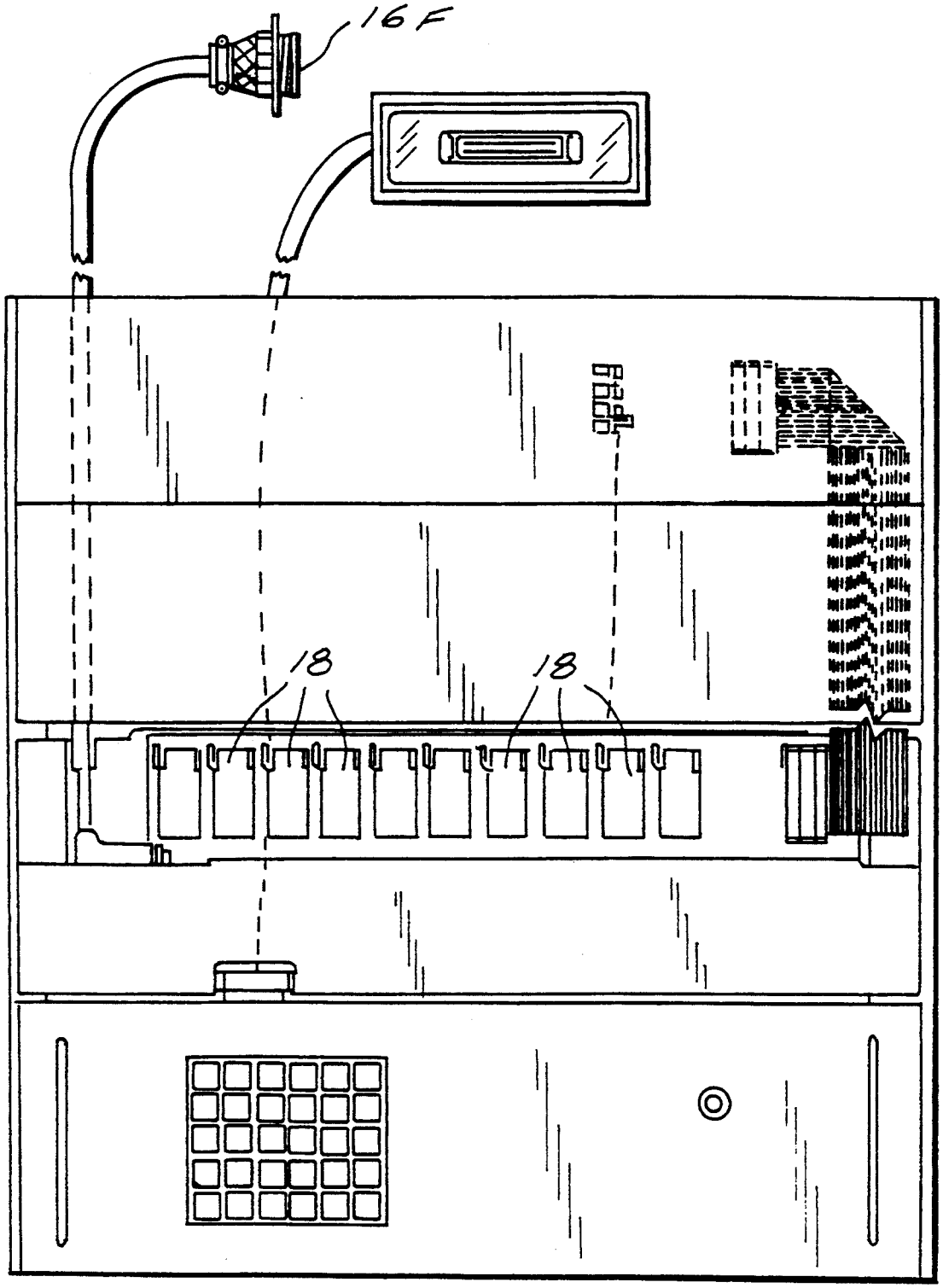
FIG. 2 illustrates in detail the components of the invention mounted within the main control cabinet of the machine.

Referring to the drawing, FIGS. 1 and 2 illustrate a pocket-setting machine 10 and implementation therein of the Style Group Recognition System of the present invention. The machine 10 includes conventional working surface areas and equipment needed to:

a) fold a pocket into a prescribed configuration required in accordance with a selected style or design;

b) deposit the folded pocket accurately upon an item of apparel (e.g. a shirt, front);

c) clamp the folded pocket thereupon prior to transferring the workpiece and pocket to a sewing station where a stitching pattern dictated by the design of the pocket is implemented by computerized control.

Figure 3:
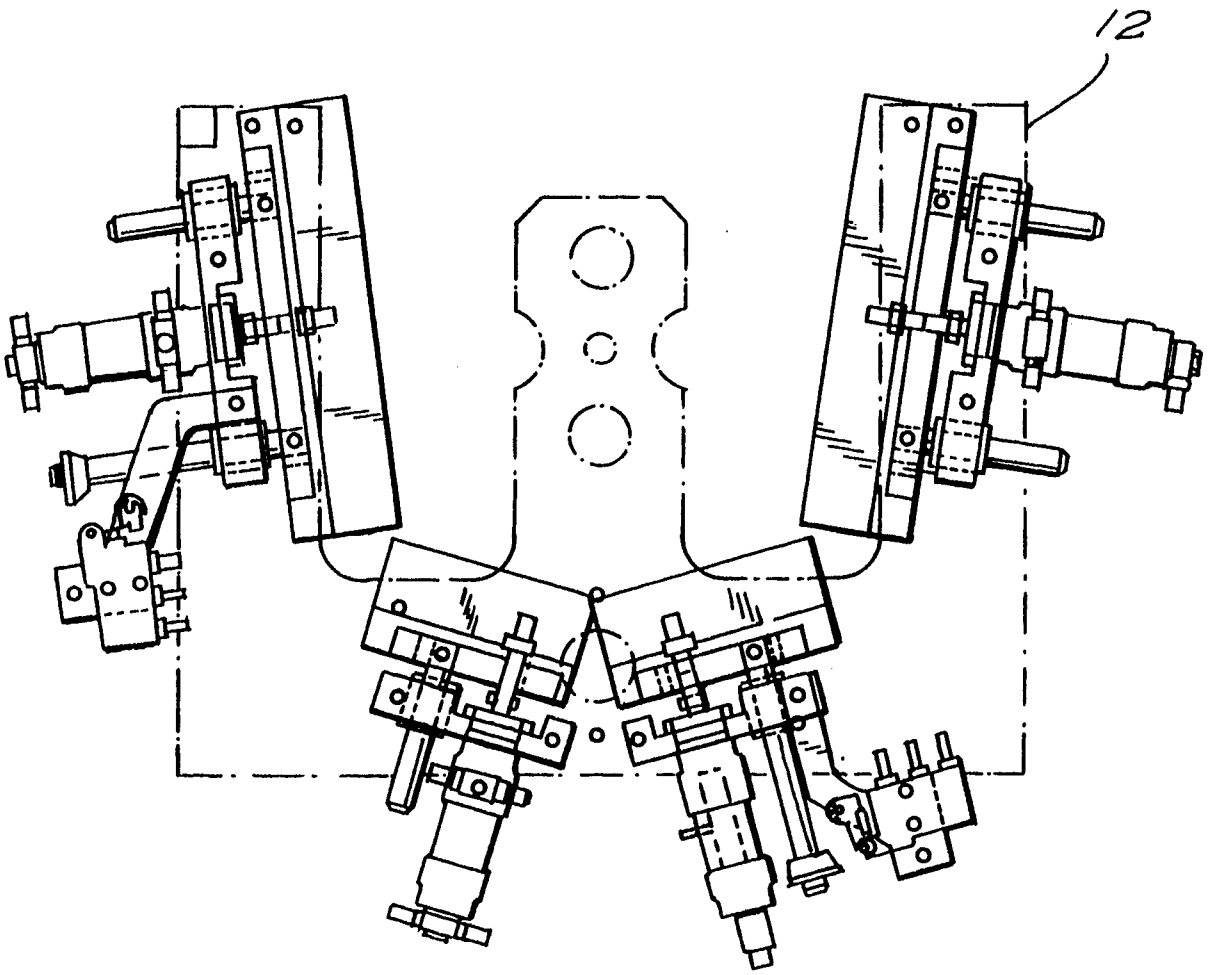
FIG. 3 illustrates a typical Folding Group with a coded connector.
Figure 4:
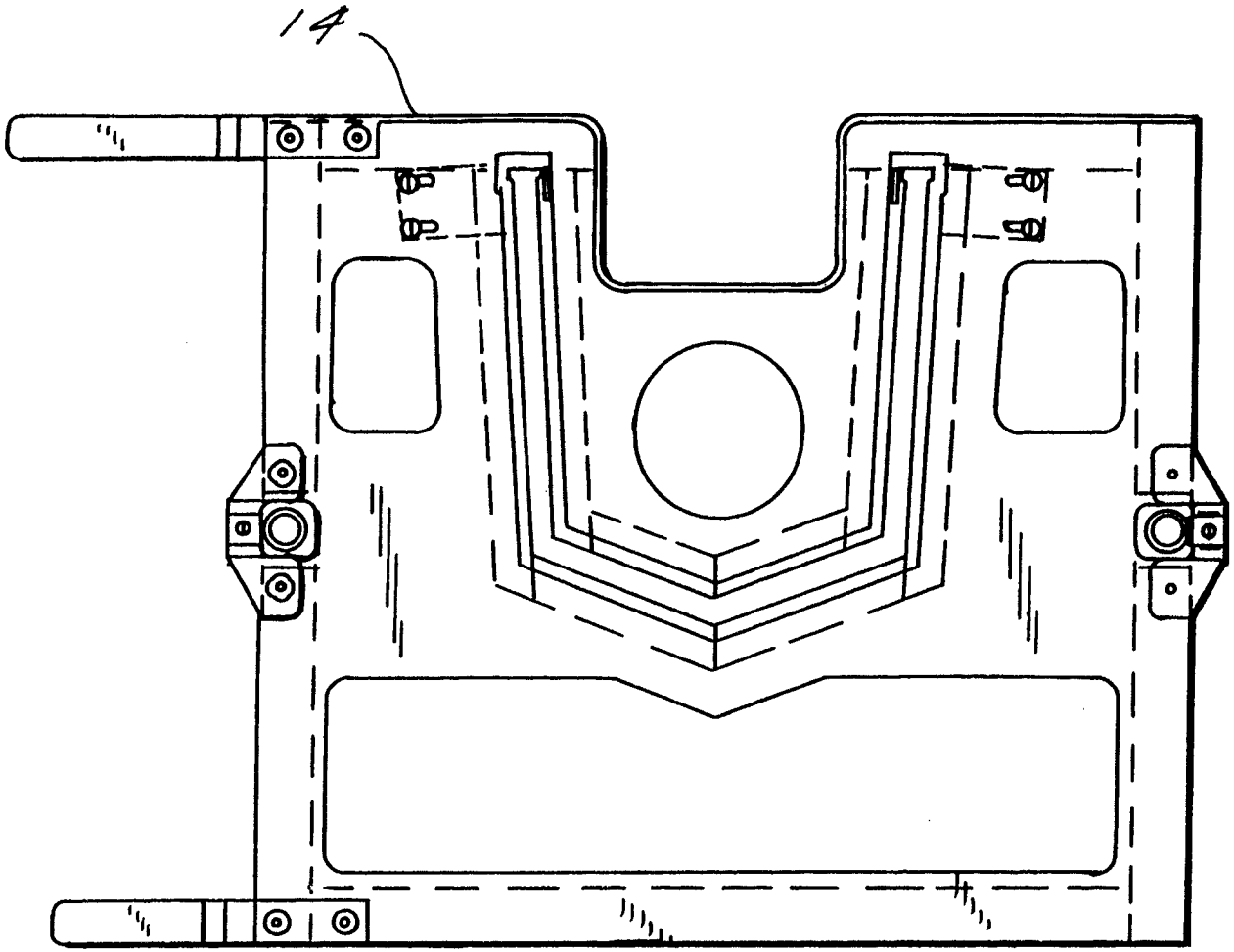
FIG. 4 illustrated a typical Stitching Clamp (for reference purposes only).

The pocket setting apparatus 10 includes a table 11 which shall receive from a pocket folder 12 (for reference see FIG. 3) a pocket folded according to the configuration of a chosen style. A stitching clamp 14 mounted upon transfer arm 15 is adapted to swing between folding station 16 and sewing station 17 to move a workpiece and pocket clamped thereupon from station 16 to station 17. The stitching clamp 14 and pocket folder 12 shall be designated herein as comprising a hardware style group, since these members are specially designed and coordinated to produce a particular style or design. It will be understood that a pattern which the stitching clamp follows under the sewing head within the stitching clamp is dictated by the style or design which has been selected. Otherwise, the stitching needle shall impinge upon the stitching clamp with consequent damage.

Continuing the description of the various components, reference letter A is an electronic board decoder equipped with Erasable Programmable Read Only Memory sockets (FIG. 2) which may receive ten different program chips 18 each of which is capable of interoperating with the main CNC controller G with which apparatus 10 is conventionally equipped. During the initial power up of the machine, decoder A receives power via cable 4. The selected style code (matching the design of the folded pocket) shall be read by a connector 16F (FIG. 2) which is connected in the illustrated embodiment to one of the style group hardware components (the folder 12) which transmits the coded information through cable 1 to decoder board A. Once the code of the selected Style Group has been read, the decoder board scans and compares that style code with the style codes that are individually pre-programmed in each of the EPROM chips 18. If the decoder board A finds the matching style code, the designated program on the corresponding EPROM chip 18 shall be read by the machines controller G through EPROM socket F, via cable 3. The decoder board A shall display the identification of the loaded program on the Message/Error display B via cable 2, for the operator's information. If the decoder board A does not find a matching program, it shall display an error message along with a possible cause of the error. Every time the machine is powered up or after any style group change, the above process is repeated.

It will be understood that the foregoing description is merely representative and that modification thereof may be made without departing from the scope of the invention. In order to fully appreciate the scope of the invention, reference should be made to the appended claims.

We claim:

1. A method applicable to an automated system for selecting and controlling individual ones of a multiplicity of apparel stitching patterns, each individual pattern belonging to a different apparel style, each said style requiring a style group of specially designed and coordinated hardware components correlated to an individual stitching pattern, and each said style requiring the selection of an individual program for use by a computer, means for directing the information of each individual stitching pattern, said method comprising the steps of:

a) installing said hardware style group including a folding assembly and a clamp assembly in an apparatus for stitching various patterns under computerized control;

b) connecting electrically powered sensing means to said hardware style group to detect and provide coded information corresponding to the specific hardware style group which has been installed;

c) transmitting said coded information to a decoding means which includes stored individual programs which are code related to individual stitching patterns;

d) utilizing said decoding means to make a determination as to whether any one of the stored programs correctly matches the code identifying the hardware style group, and;

e) in the event that said determination is positive, effecting implementation of the program by integrating said program into said computer means for directing and controlling formation of the selected stitching pattern.

2. The method according to claim 1 wherein in the event that said determination is negative, the decoding means shall inform the operator of the apparatus to this effect, but take no action to implement any program.

3. An automated apparatus for effecting a multiplicity of apparel stitching patterns, each individual pattern defining in part a different apparel style comprising a stitching means, said apparatus including a hardware group including a folding apparatus and a clamping apparatus cooperating with said stitching means to define an individual stitching pattern unique to each apparel style, computerized control means for said stitching means and individual program means for directing and controlling the formation of said individual stitching pattern, means for providing a code to identify and match each hardware group with a said program, a decoding means and a plurality of stitching programs individually integrated with said computer control means, means for connecting said individual hardware group to said decoding means for sensing a code corresponding to an individual hardware group after installation thereof in said apparatus and transmitting the sensed code to said decoding means, said decoding means having means to scan respective code identifications of said plurality of stitching programs, and computerized control means to effect implementation of a program which has been code-identified by said decoding means to match the code of said installed hardware group.

4. The apparatus of claim 3 in which the program means comprises individual erasable programmable read only memory means.

5. The apparatus of claim 3 wherein the apparatus is a pocket-setting machine.

6. An automated apparatus for effecting a multiplicity of apparel stitching patterns, each individual pattern defining in part a different apparel style, which comprises (a) computer controlled stitching means, (b) said computer controlled stitching means including memory means containing a plurality of individually code-identified stitching programs, (c) a hardware group removably installed in said automated apparatus and including a part folder, a stitching clamp, and a means for providing identifying code, (d) means electrically connecting said hardware group to said computer controlled stitching means, whereby said stitching means is supplied with said identifying code, and (e) control means to effect implementation of an individually code identified stitching program corresponding to the said identifying code of said hardware group.

* * * * *